US005571266A

United States Patent [19]

Nichols

[11] Patent Number: 5,571,266

[45] Date of Patent: Nov. 5, 1996

[54] UNIVERSAL SPORTS NET SYSTEM

[76] Inventor: Donald H. Nichols, 2453 Studebaker Rd., Long Beach, Calif. 90815

[21] Appl. No.: 634,582

[22] Filed: Apr. 18, 1996

[51] Int. Cl.[6] ..... A63B 63/00

[52] U.S. Cl. ..... 273/400; 273/57.2; 273/127 R

[58] Field of Search ..... 273/411, 57.2, 273/127 R, 127 B, 127 C, 400

[56] References Cited

U.S. PATENT DOCUMENTS

| | | | |
|---|---|---|---|
| D. 309,170 | 7/1990 | Bisch | D21/201 |
| 3,840,228 | 10/1974 | Greaney | 273/57.2 |
| 3,979,120 | 9/1976 | Dietrich | 273/127 B |
| 4,344,621 | 8/1982 | Baker | 273/57.2 X |
| 5,205,564 | 4/1993 | Lamberti et al. | 273/400 |
| 5,246,229 | 9/1993 | Carey | 273/127 C |
| 5,277,430 | 1/1994 | Naccarato | 273/400 |
| 5,413,340 | 5/1995 | Potvin et al. | 273/127 B |
| 5,421,586 | 6/1995 | Amram et al. | 273/400 |
| 5,427,381 | 6/1995 | Macaluso et al. | 273/400 |

*Primary Examiner*—William H. Grieb

[57] ABSTRACT

A new Universal Sports Net System for providing a sports net that facilitates improvement of the user's game by allowing the user to practice various sports in the convenience of their garage in all weather conditions and providing convenient storage thereof. The inventive device includes a netting structure, a padded floor structure attached to the netting structure reducing bouncing balls, and a garage door securing means that holds the present invention to a garage door during use and for storage.

5 Claims, 3 Drawing Sheets

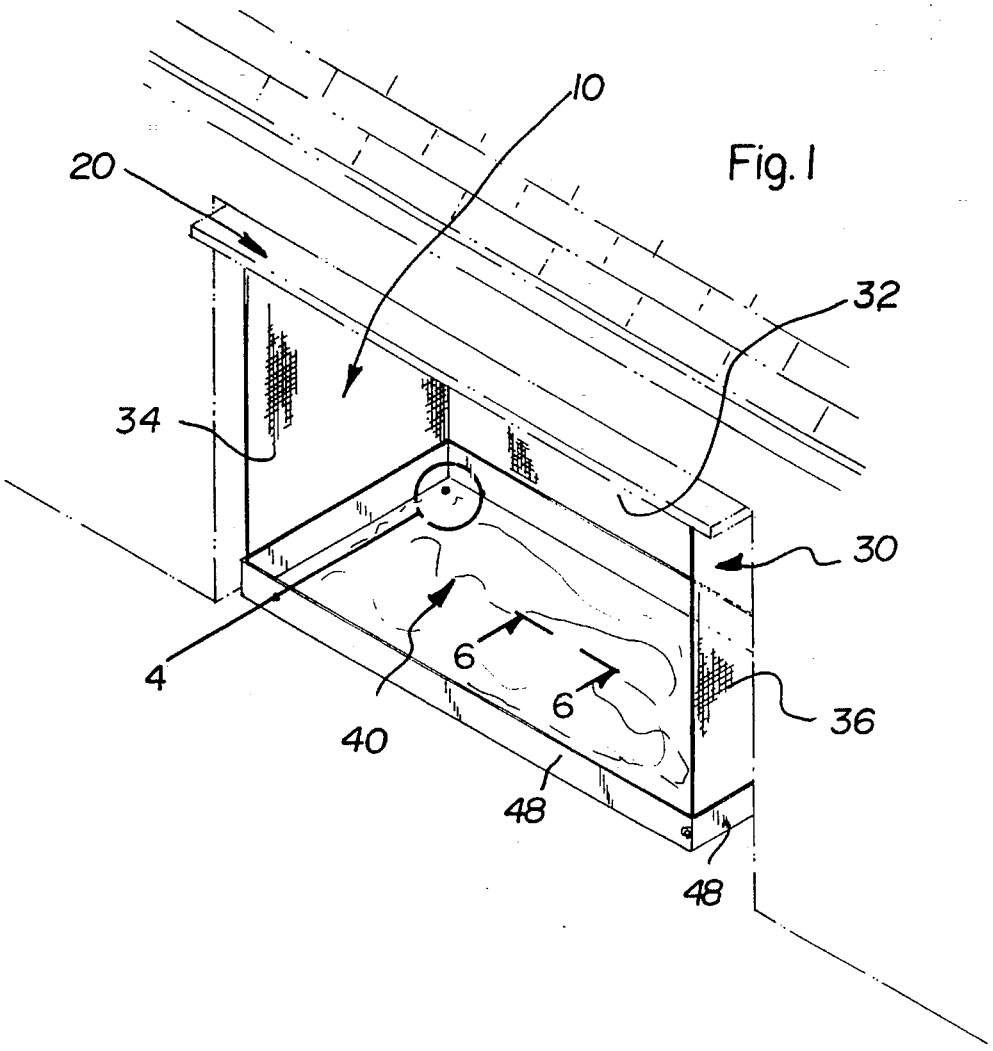
Fig. 1
Fig. 2
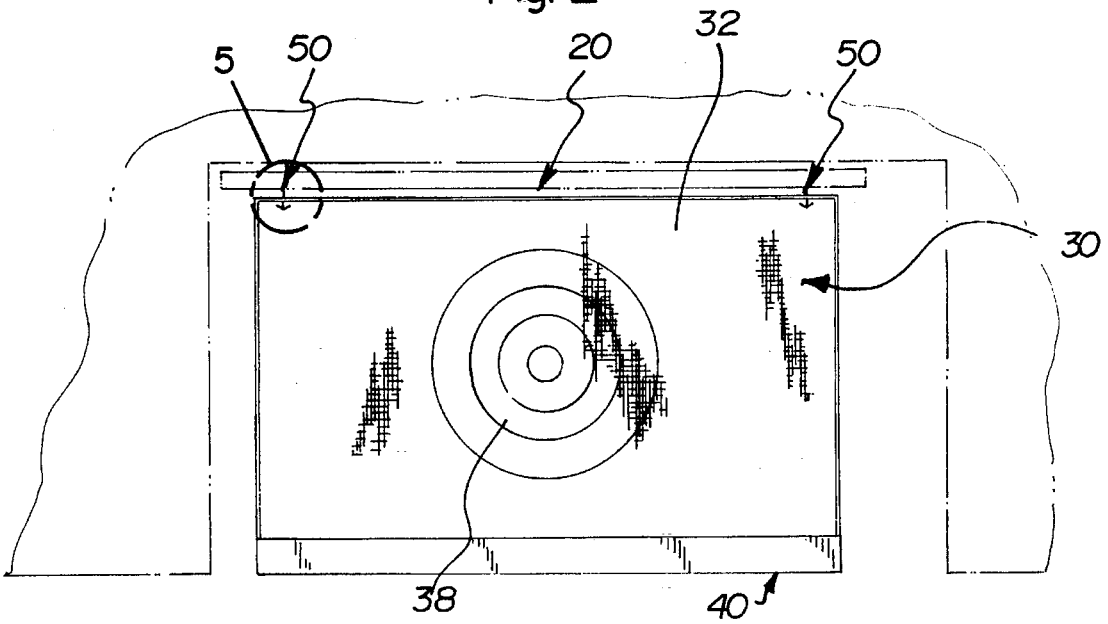

UNIVERSAL SPORTS NET SYSTEM

BACKGROUND OF THE INVENTION

1. Field of the Invention

The present invention relates to Sports Net Devices and more particularly pertains to a new Universal Sports Net System for providing a sports net that facilitates improvement of the user's game by allowing the user to practice various sports in the convenience of their garage in all weather conditions and providing convenient storage thereof.

2. Description of the Prior Art

The use of Sports Net Devices is known in the prior art. More specifically, Sports Net Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Sports Net Devices include U.S. Pat. Nos. 5,413,340; 5,421,586; 5,427,381; U.S. Pat. No. Des. 309,170; 5,246,229 and 3,979,120.

While these devices fulfill their respective, particular objectives and requirements, the aforementioned patents do not disclose a new Universal Sports Net System. The inventive device includes a netting structure, a padded floor structure attached to the netting structure reducing bouncing balls, and a garage door securing means that holds the present invention to a garage door during use and for storage.

In these respects, the Universal Sports Net System according to the present invention substantially departs from the conventional concepts and designs of the prior art, and in so doing provides an apparatus primarily developed for the purpose of providing a sports net that facilitates improvement of the user's game by allowing the user to practice various sports in the convenience of their garage in all weather conditions and providing convenient storage thereof.

SUMMARY OF THE INVENTION

In view of the foregoing disadvantages inherent in the known types of Sports Net Devices now present in the prior art, the present invention provides a new Universal Sports Net System construction wherein the same can be utilized for providing a sports net that facilitates improvement of the user's game by allowing the user to practice various sports in the convenience of their garage in all weather conditions and providing convenient storage thereof. The general purpose of the present invention, which will be described subsequently in greater detail, is to provide a new Universal Sports Net System apparatus and method which has many of the advantages of the Sports Net Devices mentioned heretofore and many novel features that result in a new Universal Sports Net System which is not anticipated, rendered obvious, suggested, or even implied by any of the prior art Sports Net Devices, either alone or in any combination thereof.

To attain this, the present invention generally comprises a netting structure, a padded floor structure attached to the netting structure reducing bouncing balls, and a garage door securing means that holds the present invention to a garage door during use and for storage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Universal Sports Net System apparatus and method which has many of the advantages of the Sports Net Devices mentioned heretofore and many novel features that result in a new Universal Sports Net System which is not anticipated, rendered obvious, suggested, or even implied by any of the prior art Sports Net Devices, either alone or in any combination thereof.

It is another object of the present invention to provide a new Universal Sports Net System which may be easily and efficiently manufactured and marketed.

It is a further object of the present invention to provide a new Universal Sports Net System which is of a durable and reliable construction.

An even further object of the present invention is to provide a new Universal Sports Net System which is susceptible of a low cost of manufacture with regard to both materials and labor, and which accordingly is then susceptible of low prices of sale to the consuming public, thereby making such Universal Sports Net System economically available to the buying public.

Still yet another object of the present invention is to provide a new Universal Sports Net System which provides in the apparatuses and methods of the prior art some of the advantages thereof, while simultaneously overcoming some of the disadvantages normally associated therewith.

Still another object of the present invention is to provide a new Universal Sports Net System for providing a sports net that facilitates improvement of the user's game by allowing the user to practice various sports in the convenience of their garage in all weather conditions and providing convenient storage thereof.

Yet another object of the present invention is to provide a new Universal Sports Net System which includes a netting structure, a padded floor structure attached to the netting structure reducing bouncing balls, and a garage door securing means that holds the present invention to a garage door during use and for storage.

Even still another object of the present invention is to provide a new Universal Sports Net System wherein the user is able to utilize the present invention in all types of weather to improve their game in various sports.

Another object of the present invention is to provide a new Universal Sports Net System wherein the user is able to conveniently store the present invention.

Still another object of the present invention is to provide a new Universal sports Net System wherein the user is able to quickly assemble the present invention for convenient use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a right side perspective view of a new Universal Sports Net System according to the present invention.

FIG. 2 is a front view thereof.

DESCRIPTION OF THE PREFERRED EMBODIMENT

Figure 3:
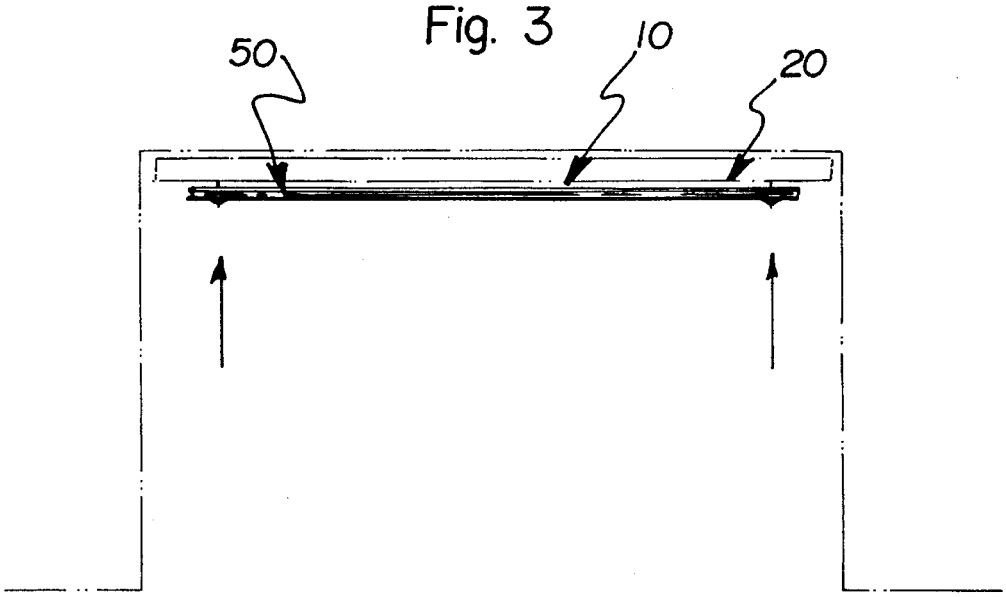
FIG. 3 is a front view of the present invention in the stored position.
Figure 4:
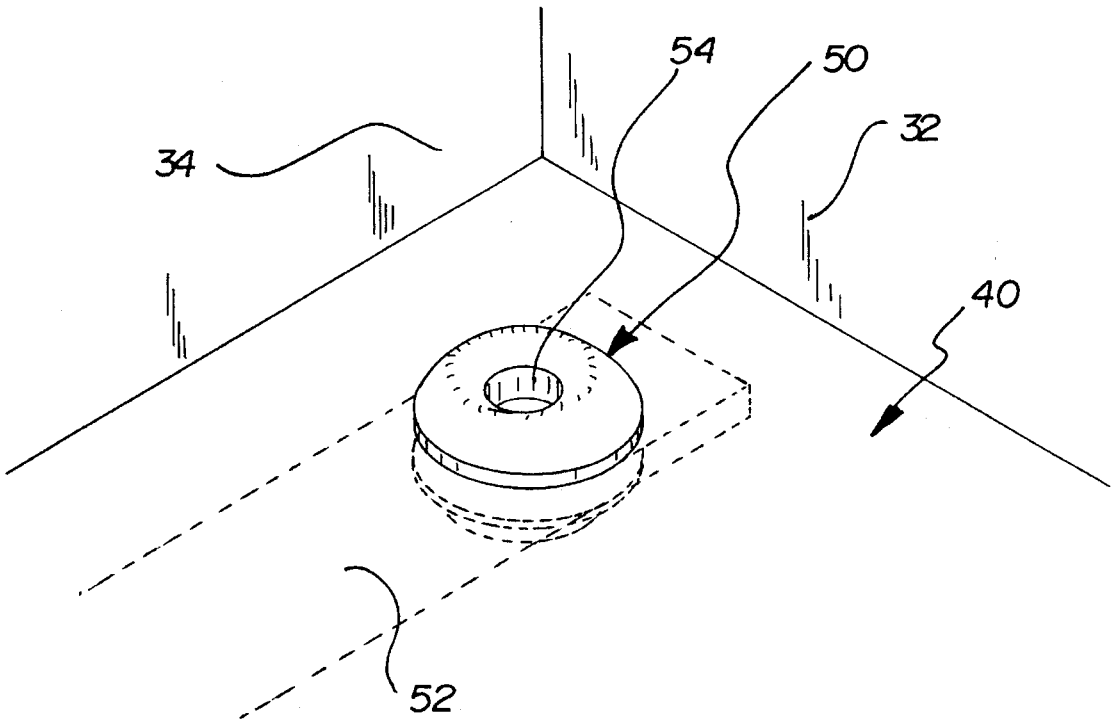
FIG. 4 is an exploded view of the garage door securing means from FIG. 1.
Figure 5:
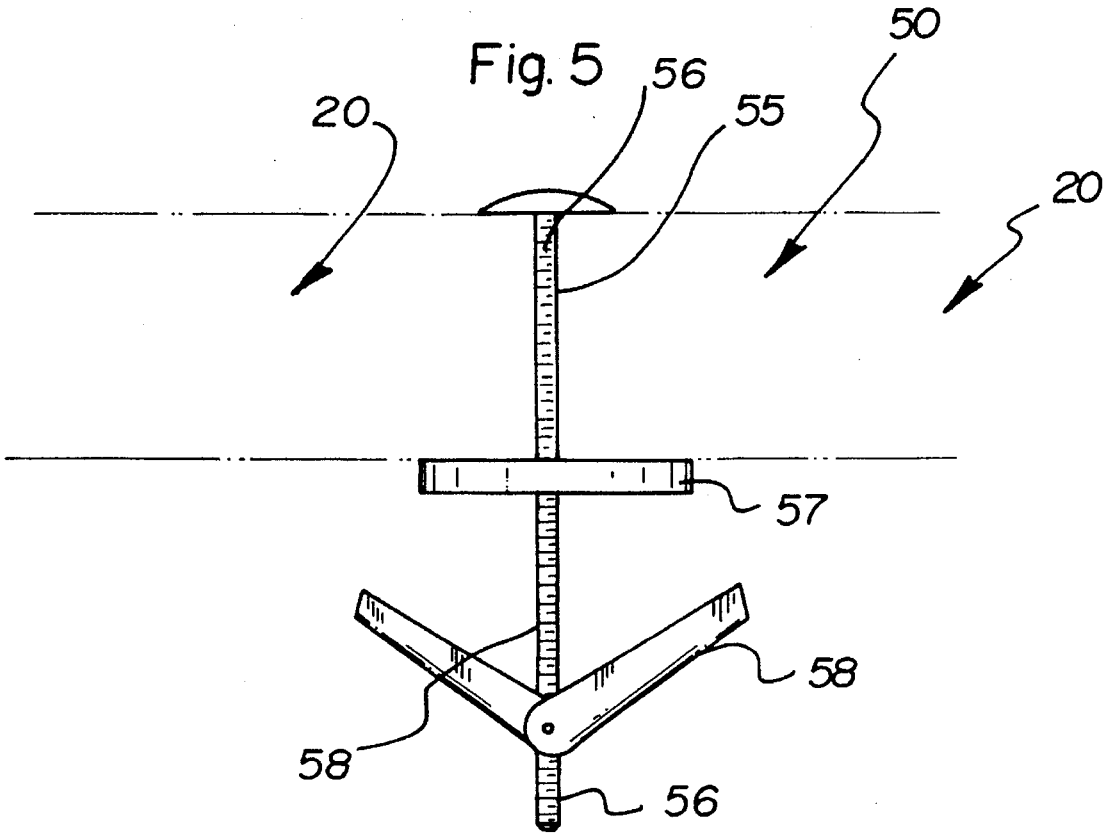
FIG. 5 is an exploded view of the garage door securing means from FIG. 2.
Figure 6:
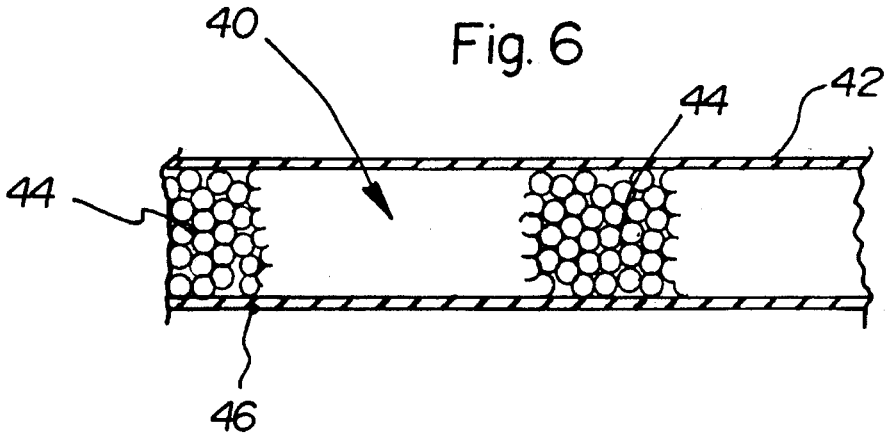
FIG. 6 is a cross sectional view taken along line 6—6 of FIG. 1.

With reference now to the drawings, and in particular to FIGS. 1 through 6 thereof, a new Universal Sports Net System embodying the principles and concepts of the present invention and generally designated by the reference numeral 10 will be described.

More specifically, it will be noted that the Universal Sports Net System 10 comprises a netting structure 30, a padded floor structure 40 attached to the netting structure 30, a garage door securing means 50 engaging the padded floor structure 40 and the netting structure 30, and a garage door 20 where the garage door securing means 50 is attached.

As best illustrated in FIGS. 1 through 6, it can be shown that a right netting wall 36 is secured orthogonally to a rear netting wall 32. A left netting wall 34 is secured orthogonally to the rear netting wall 32 opposite of the right netting wall 36. The rear netting wall has a target imprint 38 in the center. A netting ceiling 31 is secured orthogonally to the right netting wall 36, the rear netting wall 32, and the left netting wall 34 forming the netting structure 30 which retains sports objects projected into the present invention. The padded floor structure 40 includes a top floor member 42, a padding material 44 positioned below the top floor member 42, a bottom floor member 46 positioned below the padding material 44 and a side floor retainer 48 secured from around the perimeter of the top floor member 42 to the bottom floor member 46 thereby retaining the padding material 44 within the padded floor structure 40. The padding material 44 reduces the bounce of sports balls to prevent them from projecting out of the present invention. At least one floor support member 52 is located within the padded floor structure 40 near one side to support the present invention during storage. A storage aperture 54 projects into the top floor member 42, the floor support member 52, and the bottom floor member 46. The garage door securing means 50 includes at least one securing shaft 56 projecting through a securing shaft aperture 55 in the garage door. A securing shaft retainer 57 is secured to the securing shaft 56 supporting the netting ceiling 31 to the interior side of the garage door 20. A winged toggle 58 is fastened to the end of the securing shaft 56. The winged toggle 58 retracts allowing projection of the garage door securing means 50 through the storage aperture 54. The winged toggle 58 expands engaging the lower side of the bottom floor member 46 retaining the present invention in the storage position.

In use, the user creates at least one storage aperture 54 into the garage door 20. After inserting the garage door securing means 50 into the storage aperture 54, the user is then able to manually elevate the padded floor structure 40 onto the securing shaft 56 and then expanding the winged toggle 58 to store the present invention. To operate the present invention, the user simply retracts the winged toggle 58 which allows the padded floor structure 40 to descend until in the proper position for operation. The securing shaft retainer 57 supports the netting structure 30 during operation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Universal Sports Net System comprising:

a netting structure;

a padded floor structure attached to the netting structure;

a garage door securing means engaging the padded floor structure; and a garage door where the garage door securing means is attached.

2. The Universal Sports Net System of claim 1, wherein the netting structure includes a right netting wall secured orthogonally to a rear netting wall, a left netting wall secured orthogonally to the rear netting wall opposite of the right netting wall wherein the rear netting wall has a target imprint in the center and a netting ceiling secured orthogonally to the right netting wall, the rear netting wall, and the left netting wall.

3. The Universal Sports Net System of claim 2, wherein the padded floor structure includes a top floor member, a padding material positioned below the top floor member, a bottom floor member positioned below the padding material and a side floor retainer secured from around the perimeter of the top floor member to the bottom floor member thereby retaining the padding material within the padded floor structure.

4. The Universal Sports Net System of claim 3, wherein the padded floor structure further includes at least one floor support member located within the padded floor structure near one side, a storage aperture into the top floor member, the floor support member, and the bottom floor member.

5. The Universal Sports Net System of claim 4, wherein the garage door securing means includes at least one securing shaft projecting through a securing shaft aperture in the garage door, a securing shaft retainer secured to the securing shaft supporting the netting ceiling to the interior side of the garage door, and a winged toggle fastened to the end of the securing shaft that retracts allowing projection of the garage door securing means through the storage aperture and expands engaging the lower side of the bottom floor member.

* * * * *